United States Patent [19]

Abraham et al.

[11] 4,197,901

[45] Apr. 15, 1980

[54] FOUNDRY SAND MOLDING APPARATUS

[75] Inventors: Edward D. Abraham, Brecksville, Ohio; Rodney L. Hartung, Muscatine, Iowa

[73] Assignee: Carver Foundry Products, Muscatine, Iowa

[21] Appl. No.: 888,381

[22] Filed: Mar. 20, 1978

[51] Int. Cl.[2] ..... B22C 15/34

[52] U.S. Cl. ..... 164/154; 164/183; 164/192; 164/197

[58] Field of Search ..... 164/39, 154, 183, 184, 164/192, 193, 196, 197, 206; 210/285; 239/513

[56] References Cited

U.S. PATENT DOCUMENTS

| | | | |
|---|---|---|---|
| 1,791,583 | 2/1931 | Stoney | 164/39 |
| 2,220,082 | 11/1940 | Daugherty | 239/513 X |
| 3,200,449 | 8/1965 | Hatch | 164/193 |
| 3,406,738 | 10/1968 | Hunter | 164/183 X |

*Primary Examiner*—Robert D. Baldwin

[57] ABSTRACT

Foundry sand molding apparatus includes a head and table between which sand molds are squeezed. The head is rotatably indexable about a horizontal axis above the table, and carries different cope and drag squeeze boards selectively alignable with the table for producing different cope and drag sand molds on the same apparatus. The head has a sand supply passage therethrough and is rotatably indexable to a sand supply position with the passage vertically aligned with the table for supplying sand therethrough to a flask supported on the table. The head is rotatable in either of opposite directions from its sand supply position for selectively aligning either the cope or drag squeeze board with the table. Baffles extending across the sand supply passage perpendicular to one another are individually adjustable for adjusting the distribution of sand supplied through the passage. Pneumatically operated vibrators are associated with each squeeze board, and position responsive valve means is responsive to the position of the head for supplying air only to the vibrator associated with the squeeze board aligned with the table.

20 Claims, 8 Drawing Figures

FOUNDRY SAND MOLDING APPARATUS

BACKGROUND OF THE INVENTION

This application relates generally to the art of molding and, more particularly, to foundry sand molding apparatus of the type wherein sand molds are formed by squeezing sand between a head and table. However, it will be appreciated that certain aspects of the invention may be used in apparatus of other types.

Apparatus for making foundry sand molds commonly include a head and table between which sand is squeezed to form a sand mold. A flask positioned on the table in surrounding relationship to a pattern is filled with sand, and the sand is then squeezed between the head and table to form the sand mold.

In the most common apparatus of the type described, and particularly apparatus for green sand molding, the squeeze board on the head is essentially flat and the flask is substantially filled with sand. The rear surface of the resulting sand mold, opposite from the front or cavity forming surface, is substantially flat. The mold also varies in thickness between its front and rear surfaces. This arrangement is rather wasteful of sand because a large volume of sand is required for each mold. The resulting molds are also very heavy and bulky, and this complicates handling of same. Therefore, shell molding techniques have been developed for manufacturing shell molds having a rear surface which generally follows the contour of the front surface. The mold has a substantially constant thickness between its front and rear surfaces. Shell molds are manufactured in several different ways, including spreading a substantially uniform layer of chemical or resin bonded sand over a pattern and then curing the sand. Shell molds are also manufactured by the use of squeeze boards having a contour generally corresponding to that of the pattern. The substantially mating squeeze board and pattern define a cavity between them of substantially uniform thickness. This manufacturing procedure can be used with green sand molding, or with chemical or resin bonded sand. It is also known to produce shell molds by using a flexible diaphragm which is forced by air pressure against a pattern for compacting sand located between the diaphragm and pattern. The diaphragm will generally correspond to the shape of any pattern for producing a shell mold.

With apparatus of the type described using squeeze boards shaped to correspond generally with the pattern contour, it is usually necessary to have different squeeze boards for the cope and drag sand mold sections. Therefore, two molding machines are required for producing the cooperating cope and drag sand mold sections so they can be poured in an orderly and efficient manner. The requirement of having two molding machines makes the operation very expensive, and occupies a large amount of valuable space in a manufacturing facility. It is not efficient to use a single machine for manufacturing a plurality of cope mold sections and then shut the machine down for changing the squeeze board to manufacture a corresponding number of drag mold sections. It would be desirable to have a foundry sand molding apparatus which was capable of efficiently manufacturing different cope and drag sand mold sections.

In conventional foundry sand molding apparatus, sand is simply supplied to the flask with little regard to uniform sand distribution. However, when using squeeze boards shaped to the same general contour as the pattern, it is desirable to have a more uniform distribution of sand covering the pattern.

SUMMARY OF THE INVENTION

Foundry sand molding apparatus of the type described includes a spaced head and table between which foundry sand molds are formed by squeezing sand in a flask surrounding a pattern positioned on the table. The head carries a plurality of different squeeze boards shaped to generally correspond with the contour of different patterns, and is indexable for selectively aligning the squeeze boards with the table to form different molds.

In a preferred arrangement, the head is vertically spaced above the table and has a sand supply passage therethrough. The head is selectively indexable to a sand supply position aligning the passage with the table for supplying sand therethrough to a flask supported on the table. The head is indexable from the sand supply position to one of a plurality of selective positions for aligning one of the plurality of different squeeze boards with the table. This makes it possible to successively manufacture cope and drag sand mold sections on the same apparatus.

A plurality of spaced first baffles extend across the sand supply passage in one direction. A plurality of second baffles extend across the passage perpendicular to the first baffles. Each baffle is individually adjustable rotatably generally parallel to its length, and is also adjustable transversely of its length. The adjustability of each individual baffle makes it possible to adjust the distribution of sand supplied through the passage so a desired distribution of sand is made over the pattern in the flask.

The head is rotatably indexable about a substantially horizontal axis above the table and a pneumatically operated vibrator is associated with each squeeze board. Position responsive valve means is carried by the head for supplying air only to the vibrator associated with the squeeze board aligned with the table.

In one arrangement, with the head rotatably indexable about a horizontal axis above the table, the head is shiftable along the axis between indexed and indexable positions. In the indexed position, locking means is automatically engaged for preventing rotation of the head. Shifting movement of the head along the axis to the indexable position automatically releases the locking means to free the head for rotation. A separable coupling is also provided between the head and a head drive means for rotatably driving the head. The separable coupling is engaged in the indexable shifted position of the head, and is disengaged in the indexed position of the head. Fluid motors are provided at opposite ends of the head for shifting same along the axis between the indexed and indexable positions.

The head preferably has a straight sand supply passage therethrough, and opposite squeeze boards are positioned on opposite sides of the passage. When the head is positioned with the sand supply passage vertically aligned above the table, the head is rotatable 90° in either of opposite directions to align the cope or drag squeeze board with the table.

It is a principal object of the present invention to provide an improved foundry sand molding apparatus.

It is another object of the invention to provide a foundry sand molding apparatus which is capable of successively manufacturing different cope and drag sand mold sections.

It is another object of the invention to provide a foundry sand molding apparatus having a rotatably indexable head carrying a plurality of different squeeze boards, and also having a sand supply passage therethrough.

It is an additional object of the invention to provide an improved foundry sand molding apparatus having a sand supply passage with individually adjustable baffles extending thereacross for varying the distribution of sand supplied through the passage.

It is also an object of the present invention to provide a foundry sand molding apparatus with a pneumatically operated vibrator associated with each of a plurality of different squeeze boards on an indexable head. A position responsive valve automatically responds to the position of the head for supplying air only to the vibrator associated with the squeeze board aligned with the table.

DESCRIPTION OF A PREFERRED EMBODIMENT

Figure 1:
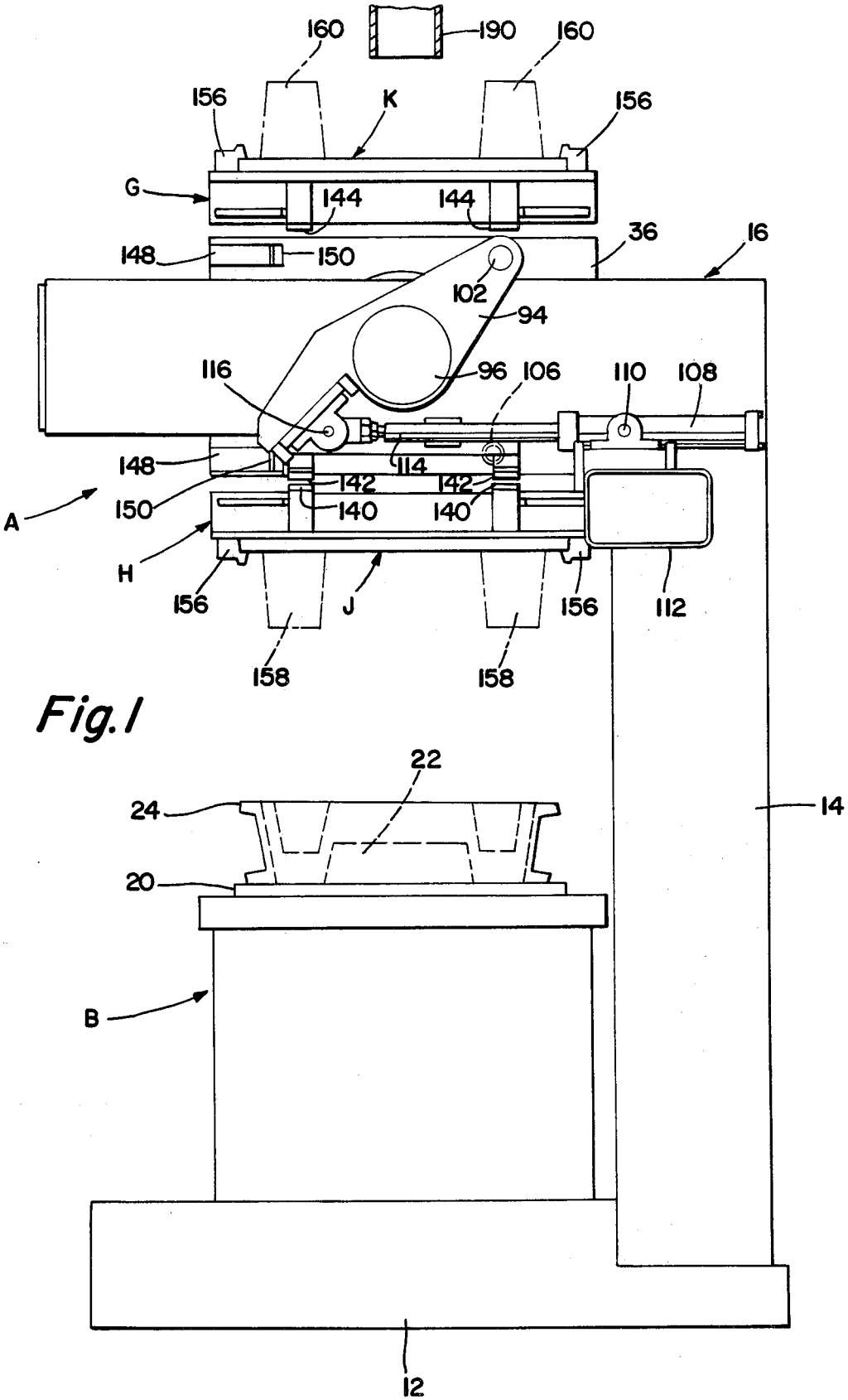
FIG. 1 is a side elevational view of a foundry sand molding apparatus constructed in accordance with the present application.

With reference to the drawing, and particularly FIG. 1, a foundry sand molding apparatus includes a base 12 having vertical frame members 14 extending upwardly therefrom, and horizontal frame members 16 extend from the upper ends of the vertical frame members 14. A head A is supported on the frame members 16 vertically above a table B on which a suitable pattern board 20 is supported. The pattern board 20 has a suitable raised pattern 22 surrounded by a flask 24 also supported on the table B. Sand is fed into the flask 24 in covering relationship to the pattern 22 and the sand is compacted or squeezed between the head A and the table B. The table B may be of a known pneumatically operated type which is vertically raisable for squeezing the sand in the flask 24 by engagement with a squeeze board carried by the head A.

Figure 2:
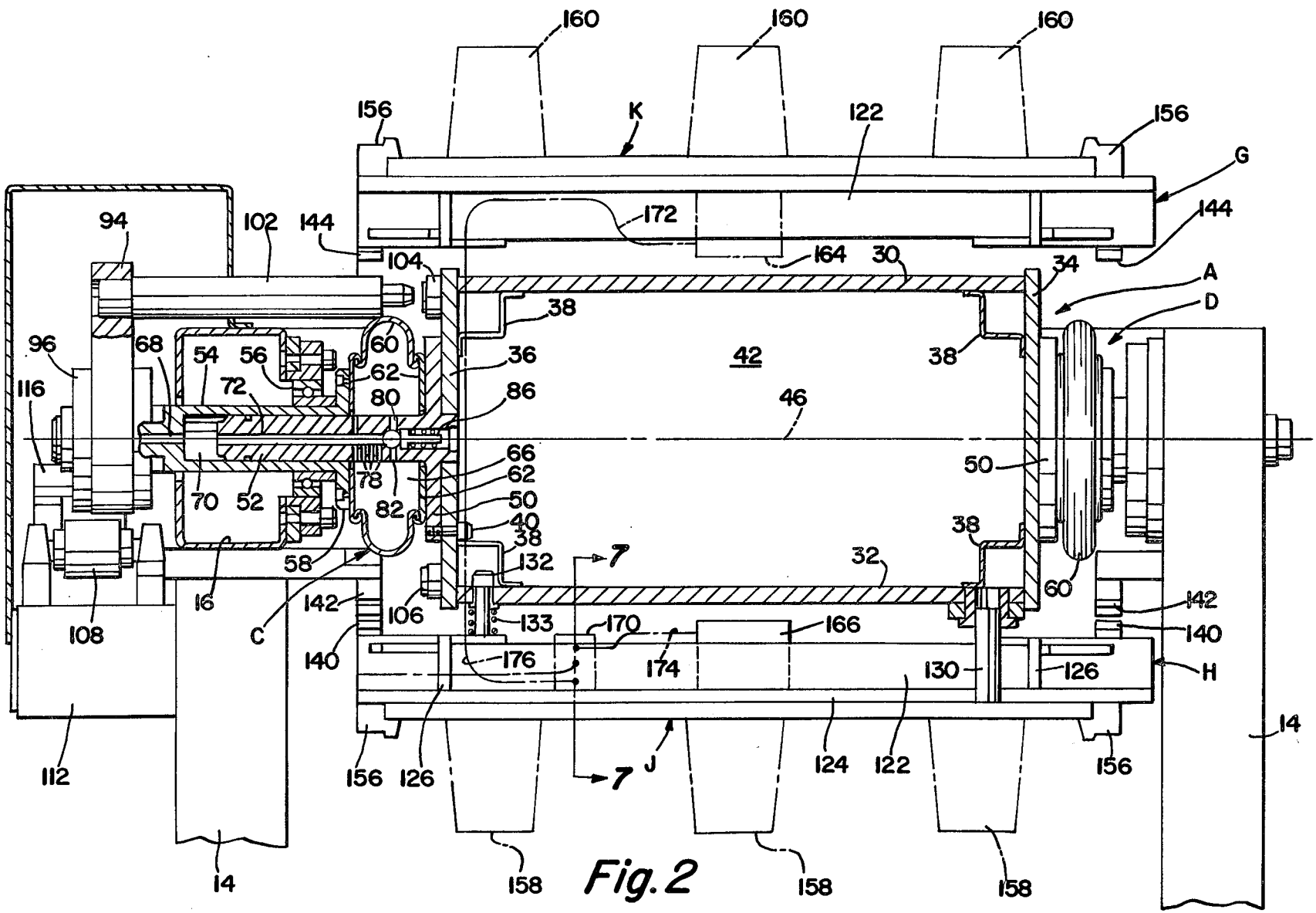
FIG. 2 is a partial rear elevational view of FIG. 1, and with portions cut-away and in section for clarity of illustration.

As best shown in FIG. 2, the head A includes a hollow rectangular structure defined by parallel spaced-apart sidewalls 30 and 32 secured to parallel spaced-apart endwalls 34 and 36. Angle members 38 are positioned at the inside corners of the hollow rectangular structure and have flanges suitably bolted to the walls 30–36 as generally indicated by bolts 40. The hollow rectangular structure defined by the walls 30–36 provide a sand supply passage 42 through the head A.

The head A is rotatably indexable and axially shiftable about and along a substantially horizontal axis 46. Identical fluid motors C and D are mounted at the opposite ends of the head A, and only fluid motor C will be fully described. A radial flange 50 on a cylindrical shaft 52 is suitably bolted or otherwise secured to the endwall 36. The shaft 52 is slidably received in a sleeve 54 rotatably mounted in bearing assembly 56 secured to the horizontal frame member 16. The sleeve 54 has a radial flange 58, and a circumferential flexible member 60 is sealingly secured at its peripheral edges to the flanges 50 and 58 by mounting plates 62 for defining an air chamber 66. A central passage 68 extends inwardly from the outer end of the sleeve 54 and intersects cylindrical bore 70 receiving the shaft 52. A central passage 72 in the shaft 52 communicates with the air chamber 66 through a plurality of small radial passages 78, and past a ball check valve 80 through larger radial passages 82. The ball check valve 80 is normally biased to a closed position by a spring biased plunger 86. A coil spring may be positioned within the air chamber 66 around the shaft 52 between the mounting plates 62 for normally biasing the plates 62 away from one another.

In order to axially shift the head from left to right in FIG. 2, air pressure is exhausted from the air motor D while air pressure is supplied to the air motor C. Air pressure is supplied through a suitable conduit connected to the passage 68 in the sleeve 54 and enters the cylindrical bore 70 to act on the end of the shaft 52 for moving same to the right in FIG. 2. The air also flows through the passage 72 in the shaft 52, and flows into the air chamber 66 through the passages 78 and 82. The air pressure within the air chamber 66 moves the plate 62 on the flange 50 to the right in FIG. 2 away from the opposite mounting plate 62 on the flange 58. This will cause axial shifting of the head A along the horizontal axis 46 to the right in FIG. 2. In order to shift the head A to the left, the air pressure is exhausted from the air motor C while being supplied to the air motor D. The head A is axially shiftable between indexable and indexed positions, and is shown in an indexed position in FIG. 2.

The head is rotatably indexable about the horizontal axis 46 and drive means for rotatably indexing same includes a lever 94 pivotally mounted by a bearing assembly 96 on the sleeve 54. A rod 102 secured to the lever 94 extends toward the head A and has an end receivable in sockets 104, 106 mounted on the endwall 36. A fluid cylinder 108 (FIG. 1) is pivotally mounted by a pin 110 to a bifurcated bracket on a frame member 112. The outer end of cylinder rod 114 is pivotally connected with the lever 94 by a suitable pin 116 on the opposite side of the pivotal axis of the lever 94 from the rod 102. The lever 94 and the cylinder 108 are arranged for rotatably indexing the head A 90° in opposite directions every time the cylinder 108 is stroked when the head is in the indexable position. The cylinder 108 is retractable or extendable when the head is in the indexed position.

In order to rotatably index the head A, air pressure is supplied to the air motor D while being exhausted from the air motor C, (see FIG. 2). This will shift the head A axially to the left in FIG. 2 to its indexable position wherein the separable coupling defined by the rod 102 and the socket 104 as 106 is engaged. Operation of the cylinder 108 will then rotate the lever 94 counterclockwise in FIG. 1 to rotatably index the head A counterclockwise 90°. The head A can simply be rotated back clockwise 90° by reverse operation of the double acting cylinder 108. However, it is also possible to operate the air motors C and D for disengaging the separable coupling 102, 104 and operating the cylinder 108 to return the lever 94 back 90° clockwise. Operation of the air motors C and D for again shifting the head A to the left to its indexable position will engage the rod 102 with the socket 106. Operation of the cylinder 108 to again rotate the lever 94 counterclockwise will then rotatably index the head A another 90° counterclockwise.

Figure 5:
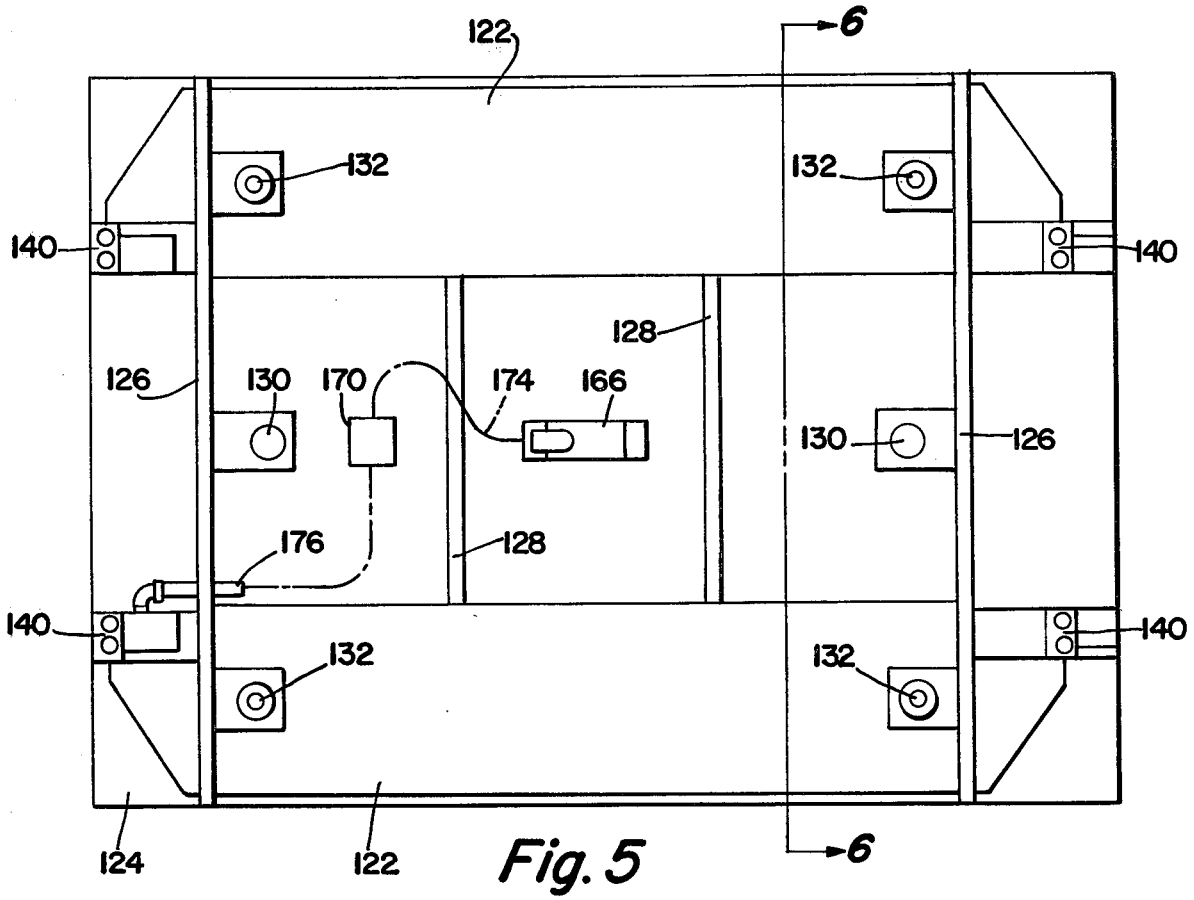
FIG. 5 is a sectional plan view taken generally on line 5—5 of FIG. 2.
Figure 6:
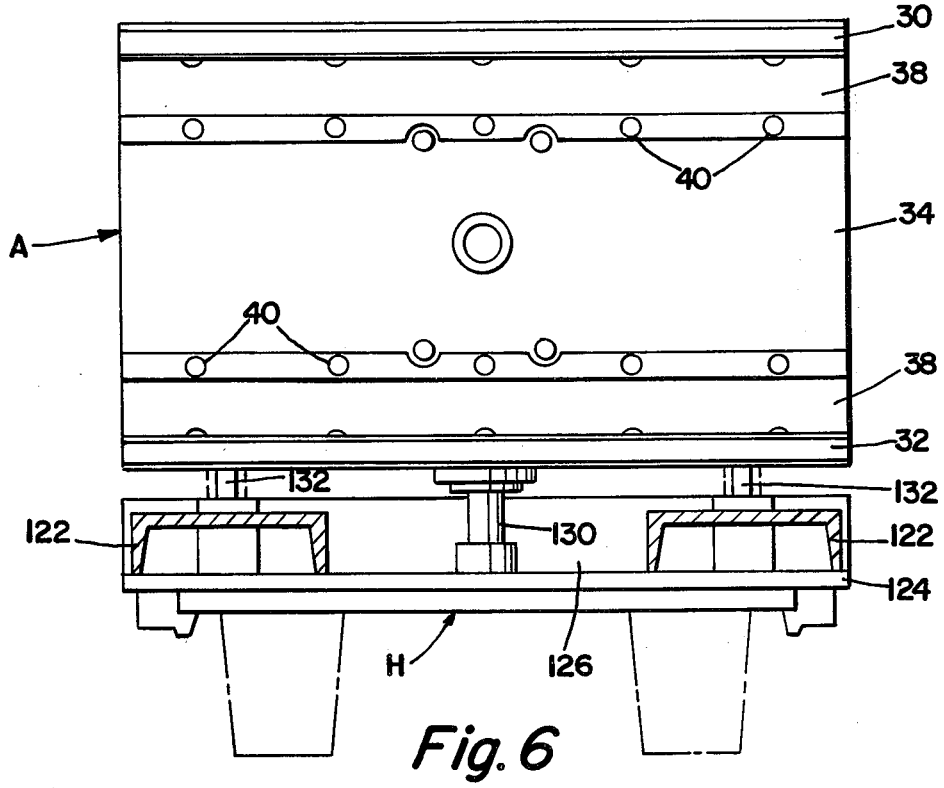
FIG. 6 is a partial cross-sectional elevational view taken generally on line 6—6 of FIG. 5.

Opposite squeeze board carriers G and H (see FIG. 1) are mounted to the opposite sidewalls 30 and 32 of the head A. As best shown in FIGS. 2, 5 and 6, the squeeze board carrier H includes opposite inverted channels 122 welded or otherwise secured adjacent the side edges of a rectangular flat plate 124. Opposite end braces 126 extend across the plate 124 at the longitudinal ends of the channels 124, and intermediate braces 128 (FIG. 5) extend along the plate 124 between the channels 122.

A pair of pins 130 located on the central longitudinal axis of the squeeze board carrier H are suitably secured thereto and to the sidewall 32. Only one of such pins 130 is shown in FIG. 2. Adjacent the four corners of the squeeze board carrier H, pin members 132 are suitably secured and are also secured to the sidewall 32. The squeeze board carrier G is similarly mounted to the sidewall 30. Preloaded springs 133 (only one of which is shown is FIG. 2) face between the index walls 30, 32 and squeeze board carriers G and H to maintain their relative positions of FIG. 2.

As shown in FIGS. 2 and 5, abutment members 140 are suitably mounted to the squeeze board carrier H for cooperation with abutment members 142 suitably secured to the vertical frame members 16. The squeeze board carrier G has stops 144 corresponding to the stops 140, and the endwalls 34, 36 are also provided with extensions 148 abutments 150 thereon corresponding to the stops 140. In the indexed position of the head A when it is shifted to the right in FIG. 2, the abutments 140 are aligned with the abutments 142 for positively holding the head A against rotation. Thus, the cooperating abutments define a releasable locking means for holding the head A against rotation while it is in its axially shifted position. However, operation of the fluid motors C and D for shifting the head A to the left in FIG. 2 will cause the abutments 140 to move to the left completely free of the abutments 142. This releases the locking means to provide free rotation of the head A when it is in its indexable position. The abutments 144 on the squeeze board carrier G and the abutments 150 on the sidewalls 34, 36 cooperate with the abutments 142 in the same manner to define a releasable locking means for holding the head A against rotation in its indexed position while providing free rotation in its indexable position. Obviously, many other types of automatically engageable and disengageable locking means may be provided between the head A and the stationary frame structure.

A cope squeeze board J is shown (FIGS. 1 and 2) clamped to squeeze board carrier H by clamp brackets 156, and a drag squeeze board K is shown clamped to the squeeze board carrier G by clamp brackets 156. Peen blocks 158 shown extending from the cope squeeze board J are simply representative of a contoured squeeze board. The cope squeeze board J is preferably contoured to generally correspond with the contour of the pattern supported on the table within the flask. A plurality of projections may be provided on the squeeze board to form depressions in the rear surface of the sand mold to generally correspond with the contour of the pattern. Projections 160 on the drag squeeze board K are also schematic representations of a contoured squeeze board which follows the general contour of the drag pattern. The cope and drag squeeze boards J and K are completely different from one another in the sense that each has a different contour for cooperation with different pattern contours for different patterns supported on the table.

Figure 7:
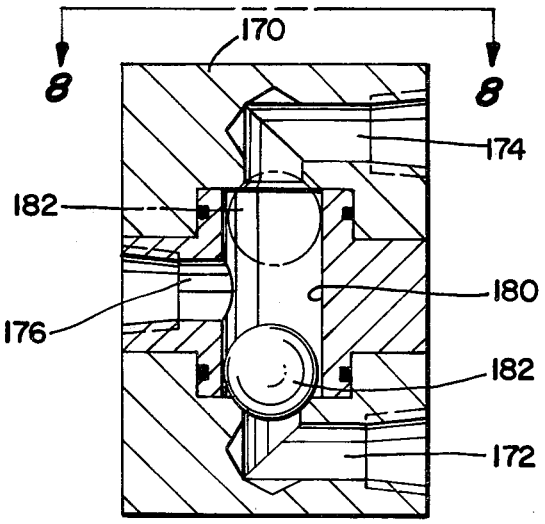
FIG. 7 is a partial cross-sectional elevational view taken generally on line 7—7 of FIG. 2.
Figure 8:
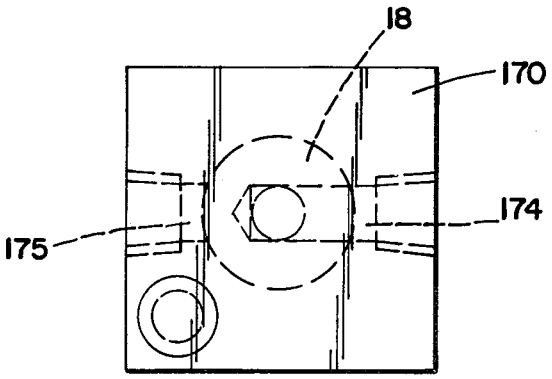
FIG. 8 is a plan view taken generally on line 8—8 of FIG. 7.

Each squeeze board carrier G, H has a pneumatically operated vibrator 164, 166 (FIG. 2) associated therewith. The vibrators are suitably bolted or otherwise mounted to the plates 124 forming part of the squeeze board carriers. A position responsive valve means 170 is suitably mounted on the squeeze board carrier H for supplying the vibrators 164, 166 with air through conduits 172, 174 from a suitable supply conduit 176. As best shown in FIGS. 7 and 8, the position responsive valve means 170 includes an internal vertical bore 180 having a movable valve member 182 in the form of a ball positioned therein. In the position shown, the ball 182 blocks air from flowing from the supply conduit 176 to the conduit 172 supplying the vibrator 164 of FIG. 2, while allowing air to flow only to the conduit 174 for the vibrator 166 associated with the squeeze board carrier H which carries the squeeze board J which is in a position vertically aligned in facing relationship to the table B of FIG. 1. When the head A is rotatably indexed 180° from the position shown in FIG. 2, the valve means 170 of FIG. 7 will also be inverted 180° so that the movable valve member 182 will move under the force of gravity to block flow of air from the supply conduit 176 to the conduit 174 feeding the vibrator 166. Air will then be supplied only from the conduit 176 to the conduit 172 supplying the vibrator 164 so that only the squeeze board carrier G and its squeeze board K will be vibrated when the squeeze board K is vertically aligned in facing relationship with the table B.

Figure 3:
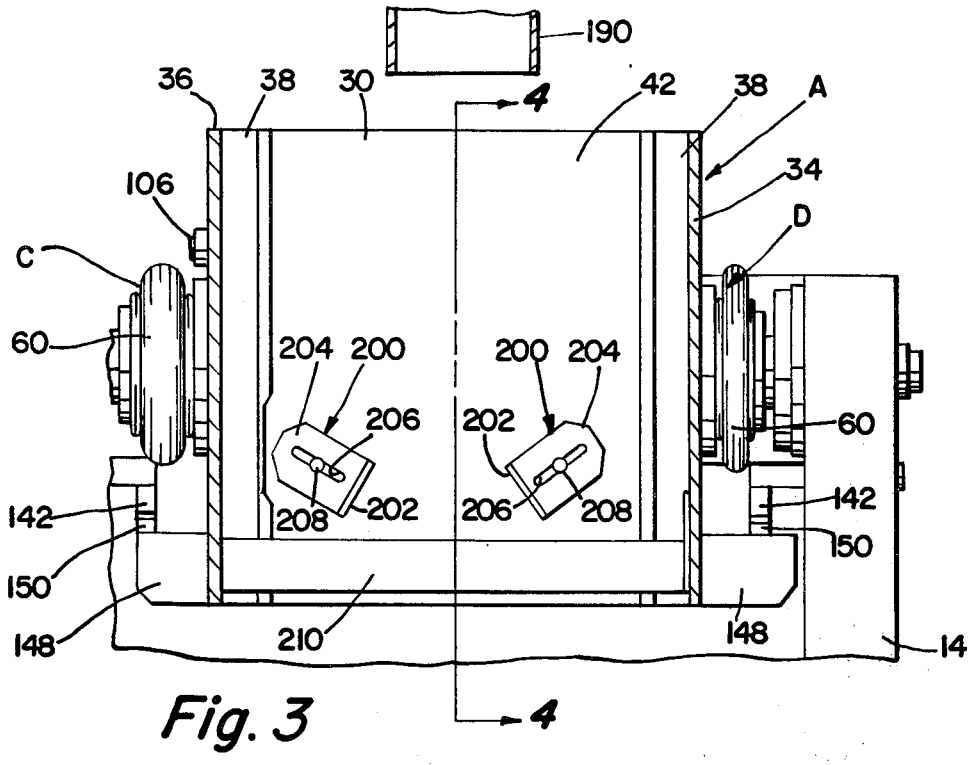
FIG. 3 is a partial cross-sectional elevational view showing a head rotatably indexed 90° from the position of FIG. 2 for vertically aligning a sand supply passage.
Figure 4:
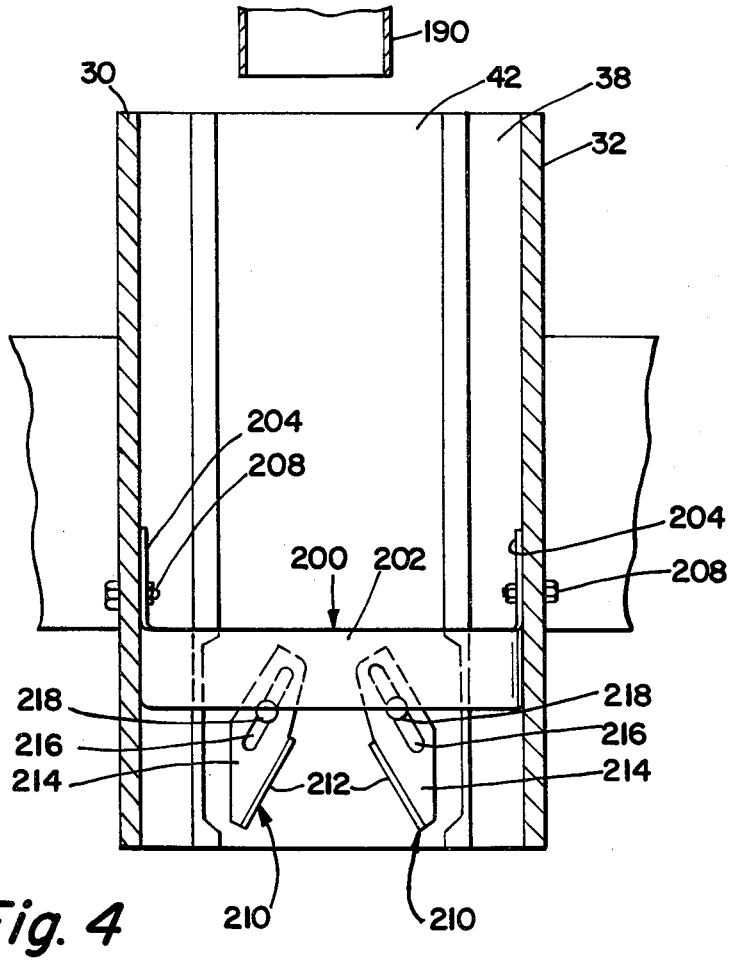
FIG. 4 is a partial cross-sectional elevational view taken generally on line 4—4 of FIG. 3.

FIGS. 3 and 4 show the head A after it has been rotated counterclockwise 90° from the position of FIG. 1. In the position of FIGS. 3 and 4, the sand supply passage 42 is vertically aligned above the table B to define a sand supply position of the head A. Sand is supplied through a suitable chute 190 for flow through the passage 42 into the flask 24 positioned on the table B.

A plurality of baffles extend across the passage 42 for selectively varying the distribution of the sand supplied therethrough. A pair of parallel spaced-apart first baffles 200 extend across the passage 42 in one direction between the sidewalls 30, 32. The baffles 200 include flat main portions 202 extending across the passage 42, and mounting flange end portions 204 having elongated slots 206 therein receiving suitable fasteners 208 for adjustably securing the baffles 200 to the sidewalls 30, 32. The elongated slots 206 are elongated in a direction perpendicular to the width of the main portions 202. Loosening of the fasteners 208 provides adjustment of the baffles 200 rotatably generally parallel to their length, and also provides transverse adjustment thereof transversely of their length. This rotational and transverse adjustment makes it possible to incline the flat main portions 202 in substantially any inclination and to vary the spacing between the baffles in order to achieve a desired distribution of sand for a particular pattern and flask.

A pair of spaced-apart second baffles 210 extend across the passage 42 perpendicular to the first baffles 200. The second baffles 210 have flat main portions 212 extending across the end walls 34, 36 and flanged mounting portions 214 with elongated slots 216 which are elongated in a direction generally parallel to the flat width of the main portions 212. Suitable fastener assemblies 218 extend through the slots 216 for securing the second baffles 210 to the endwalls 34, 36. Loosening of the fasteners 218 provides adjustment of the second baffles 210 rotatably generally parallel to their length and also transversely of their length for varying the inclination of the flat main portions 212 and also varying the spacing between the baffles to further achieve a desirable sand distribution. This advantageous arrangement provides individual adjustment for each of the mutually perpendicular baffles for obtaining an optimum sand distribution.

The head A is selectively rotatably indexable 90° from the sand supply position of FIGS. 3 and 4 to vertically align either the cope squeeze board J or the drag squeeze board K in downwardly facing relationship with the table B. This makes it possible to successively manufacture different cope and drag sand mold sections. With the head A in the position of FIGS. 3 and 4, sand is supplied through the passage 42 to a flask positioned on the table B. The head A is then axially shifted to its indexable position and rotatably indexed 90° to align the cope squeeze board J in downwardly facing relationship with the table B. The table B is then elevated to engage the sand in the flask with the squeeze board J for compacting or squeezing the sand. The air vibrator 166 associated with the cope squeeze board J is operated during the sand squeezing operation to obtain optimum compaction. The table is then lowered for discharging the completed cope sand mold. The head A is again rotatably indexed 90° to the position of FIGS. 3 and 4, and a drag pattern and flask are moved into position on the table B. Sand is then supplied through the passage 42 to the drag flask. The head A is then rotatably indexed 90° in an opposite direction for aligning the drag squeeze board K in downwardly facing relationship with the table B. The air vibrator 164 associated with the drag squeeze board K is operated while the table B is elevated to squeeze the sand in the drag flask to form a drag sand mold. This operation is repeated to successively manufacture cope and drag mold sections. Obviously, the head A is shifted axially back and forth between its indexed and indexable positions after each 90° rotation.

When the head A is in the position shown in FIG. 1, the table B can be raised to engage the sand flask 24 with the cope squeeze board J. As the table B is raised, the cope squeeze board J squeezes the sand in the cope sand flask 24. At this time the head A is in the indexed position shown in FIGS. 1 and 2. Therefore, the upward force applied against the cope squeeze board J presses the stops 140 (FIG. 1) against the stops 142 to transmit the load to the frame 16. This minimizes the operating forces applied against bearings for the head A.

After the table B has been lowered, the head A is moved to its indexable position in which the rod 102 engages the socket 104. The motor 108 is then retracted to pivot the head A in a counterclockwise direction from the position shown in FIG. 1. This positions sand passage 42 in alignment with the chute 190.

After a drage flask has been aligned with the passage 42 in the head A, sand is discharged from the chute 190 to fill the drag flask. As the drag flask is being filled and while the head A is in the indexed position of FIG. 2, the motor 108 is extended to pivot the lever 94 in a clockwise direction back to the position shown in FIG. 1. This aligns the pin 102 with the socket 106.

After the drag flask has been filled with sand and the head A moved to the indexable position, the motor 108 is again retracted to pivot the head A through 90° in a counterclockwise direction as viewed in FIG. 1. This moves the drag squeeze board K into alignment with the filled drag flask. The head A is moved back to the indexed position and the table B is again raised to engage the drag flash with the drag squeeze board K. Since the head A is now rotated 180° from the position shown in FIGS. 1 and 2, the stops 144 on the drag squeeze board K are aligned with the stationary stops 142 on the frame 16. Therefore, as the table B is raised to squeeze the drag flask, and load forces are transmitted from the stops 144 to the frame stops 142 independently of the support bearings for the head A.

After the table has been lowered, the motor 108 is extended to pivot the head A in a clockwise direction to again align and sand passage 42 with the chute 190. As a second cope sand flask is filled and while the head A is in the indexed position, the motor 108 is retracted to pivot the lever 94 counterclockwise and align the pin 102 with the socket 104 without moving the head A.

When the second cope flask has been filled with sand and the head A has been moved to the indexable position to engage the pin 102 with the socket 104, the motor 108 is again extended. This pivots the head A clockwise to the position shown in FIG. 1 in which the cope flask squeezing board J is aligned with the filled cope flask. The head A is returned to the indexed position and the table B is then raised to compact the sand in the second cope flask.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. An apparatus comprising a head rotatably indexible about a substantially horizontal axis and having a passage for supplying sand therethrough, a plurality of baffles extending across said passage for varying the distribution of sand flowing through said passage, said baffles including a plurality of spaced first baffles extending across said passage in one direction and a plurality of spaced second baffles extending across said passage substantially perpendicular to said first baffles and each said baffle being individually adjustable rotatably about an axis generally parallel to its length and also being adjustable in a direction transversely of its length.

2. The apparatus as defined in claim 1 wherein each said baffle includes a flat blade-like main portion extending across said passage and opposite mounting portions extending substantially perpendicular to said main portion, said mounting portions having elongated slots therein, said passage having sidewalls, and fasteners extending through said slots and adjustably securing said mounting portions to said sidewalls.

3. The apparatus as defined in claim 2 wherein said slots in said mounting portions on said baffles which extend in said one direction across said passage are elongated in a direction substantially perpendicular to the width of said main portions thereof, and said slots in the mounting portions of the other said baffles being elongated in a direction substantially parallel to the width of said main portions thereof.

4. Apparatus comprising a spaced head and table between which foundry sand molds are formed by squeezing sand in a flask surrounding a pattern positioned on said table, said head carrying a plurality of different squeeze boards and being indexible for selectively aligning said squeeze boards with said table to form different molds, said head being vertically spaced above said table and having a sand supply passage therethrough, said head being rotatably indexible about a substantially horizontal axis above said table, and drive means for rotatably indexing said head selectively in steps in the same direction or in an opposite direction.

5. Apparatus as defined in claim 4 wherein said drive means includes a pivoted lever powered by a fluid cylinder, a cooperable pin and socket drive connection between said head and lever for rotatably indexing said head substantially 90° when said drive connection is engaged and said lever is pivoted by operation of said fluid cylinder and said head being shiftable along said axis to engage said pin and socket drive and disengage said pin and socket drive.

6. Apparatus as set forth in claim 4 wherein said drive means comprises a pivoted drive lever connected with a fluid cylinder, a separable coupling between said lever and said head for selectively rotatably indexing said head by pivoting said lever with a drive cylinder when said coupling is engaged, and means for axially moving said head to engage and separate said coupling.

7. Apparatus as set forth in claim 6 wherein said separable coupling comprises a rod connected with said lever and a pair of diametrically spaced sockets in said head, said rod being receivable selectively in either of said sockets.

8. Apparatus as defined in claim 6 further including a first fluid motor at one axial end of said head for axially moving said head to engage said coupling, and a second fluid motor at the opposite axial end of said head for axially shifting said head to separate said coupling.

9. Apparatus as defined in claim 6 including locking means for selectively locking said head against rotation, said locking means being automatically engaged by shifting movement of said head to separate said coupling and being automatically disengaged by shifting movement of said head to engage said coupling.

10. Apparatus comprising a spaced head and table between which foundry sand molds are formed by squeezing sand in a flask surrounding a pattern positioned on said table, said head carrying a plurality of different squeeze boards and being indexible for selectively aligning said squeeze boards with said table to form different molds, said head being vertically spaced above said table and having a sand supply passage therethrough, said head being selectively indexible to a sand supply position aligning said passage with said table for supplying sand therethrough to a flask on said table, said head being indexible from said sand supply position to one of a plurality of selective positions for aligning one of said plurality of different squeeze boards with said table, and said head being rotatably indexible about a substantially horizontal axis.

11. Apparatus comprising a spaced head and table between which foundry sand molds are formed by squeezing sand in a flask surrounding a pattern positioned on said table, said head carrying a plurality of different squeeze boards and being indexible for selectively aligning said squeeze boards with said table to form different molds, a pneumatically-operated vibrator associated with each different squeeze board carried by said head, valve means carried by said head and being automatically responsive to the position of said head for supplying air only to the vibrator associated with the squeeze board aligned with said table, said head being vertically spaced above said table and rotatably indexible about a substantially horizontal axis, and said valve means having a gravity-responsive movable valve member for opening air flow to the vibrator associated with the squeeze board aligned with said table while closing air flow to the other vibrator.

12. Apparatus comprising a spaced head and table between which foundry sand molds are formed by squeezing sand in a flask surrounding a pattern positioned on said table, said head carrying a plurality of different squeeze boards and being indexible for selectively aligning said squeeze boards with said table to form different molds, said head being rotatable about a horizontal axis above said table and having a sand supply passage therethrough, said head carrying a pair of different squeeze boards on opposite sides of said passage, said head being rotatably indexible to a sand supply position with said passage aligned with said table and being selectively rotatable ninety degrees in either of opposite directions from said sand supply position to align either of said squeeze boards with said table.

13. Apparatus comprising: a head and table between which foundry sand molds are squeezed, said head being spaced vertically above said table and rotatably indexable about a substantially horizontal axis, a sand supply passage through said head, said head being rotatably indexable to a sand supply position with said passage substantially vertically aligned with said table for supplying sand therethrough to a flask on said table, at least one squeeze board carried by said head for respectively cooperating with a sand mold, and said head being rotatably indexable from said sand supply position to align said squeeze board with said table.

14. Apparatus as defined in claim 13 wherein different cope and drag squeeze boards are carried by said head for respectively cooperating with different cope and drag sand molds, and said head being selectively indexable in either of opposite directions from said sand supply position to selectively align either said cope or drag sequeeze board with said table.

15. The apparatus as defined in claim 14 wherein said head is shiftable along said axis between indexing and indexed positions, said head in said indexing position being free for rotatable indexing movement and in said indexed position being locked against rotatable indexing movement.

16. The apparatus as defined in claim 14 including drive means for rotatably indexing said head, a separable coupling between said drive means and said head, and said coupling being engaged for rotatable indexing of said head and being disengaged when said head is in a working position with said passage or one of said squeeze boards vertically aligned with said table.

17. The apparatus as defined in claim 14 including a plurality of first baffles extending across said passage in one direction and a plurality of second baffles extending across said passage substantially perpendicular to said first baffles, and each said baffle being individually adjustable for adjusting the distribution of sand supplied through said passage.

18. Apparatus comprising: a head and table between which foundry sand molds are squeezed, said head being rotatably indexable about a substantially horizontal axis above said table, a plurality of different squeeze boards carried by said head for selective alignment with said table, said head being shiftable along said axis between indexed and indexable positions, locking means for locking said head against rotation in said indexed position, and said locking means being automatically engaged upon shifting movement of said head along said axis to said indexed position and being automatically disengaged upon shifting movement of said head along said axis to said indexable position.

19. The apparatus as defined in claim 18 including drive means for rotatably indexing said head, separable coupling means between said head and drive means for transferring torque from said drive means to said head, said coupling means being engaged in said indexable position of said head and being disengaged in said indexed position of said head.

20. Apparatus comprising a head and table between which foundry sand molds are squeezed, said head carrying a plurality of different squeeze boards for cooperation with different patterns and flasks supported on said table, said head being indexible for selectively aligning one of said squeeze boards with said table, a pneumatically-operated vibrator associated with each said squeeze board, position-responsive valve means for selectively supplying air to said vibrators, said valve means being automatically responsive to the position of said head for supplying air only to the vibrator associated with the squeeze board aligned with said table while blocking air to the other vibrators, said head being rotatable about a substantially horizontal axis above said table and said valve means including a gravity-responsive movable valve member for opening air flow to the vibrator associated with the squeeze board aligned with said table while closing air flow to the other vibrators.

* * * * *